United States Patent [19]

Poynton

[11] 3,944,384

[45] Mar. 16, 1976

[54] FLAME-RETARDANT FILAMENTS

[75] Inventor: David John Poynton, Coventry, England

[73] Assignee: Courtaulds Limited, London, England

[22] Filed: Nov. 4, 1974

[21] Appl. No.: 520,714

[30] Foreign Application Priority Data

Nov. 6, 1973 United Kingdom ..... 51421/73

[52] U.S. Cl. ..... 8/115.5; 260/45.7 P; 260/45.9 R; 260/DIG. 24; 264/182

[51] Int. Cl.[2] ..... D06M 13/44

[58] Field of Search .. 8/115.5; 260/DIG. 24, 45.7 P, 260/45.9

[56] References Cited

UNITED STATES PATENTS

| | | | |
|---|---|---|---|
| 3,639,532 | 2/1972 | Oertel et al. | 260/923 |
| 3,671,611 | 6/1972 | Nachbur et al. | 260/932 |
| 3,828,228 | 3/1958 | Glade et al. | 117/136 |

*Primary Examiner*—Carman J. Seccuro
*Attorney, Agent, or Firm*—Davis, Hoxie, Faithfull & Hapgood

[57] ABSTRACT

Flame-retardant acrylic filaments containing a flame retardant which is the reaction product of a dibasic acid amide, an oxyacid of phosphorus and a polyhydroxy alcohol, the flame retardant being bound to the acrylic filaments by a cross-linking agent. The filaments are made flame-retardant by applying the flame retardant and cross-linking agent to the filaments and subsequently heating the filaments to chemically bind the flame retardant to the acrylic filaments.

11 Claims, No Drawings

FLAME-RETARDANT FILAMENTS

This invention relates to flame-retardant acrylic filaments and to a process for making them. The term acrylic filaments means filaments of polyacrylonitrile and filaments of copolymers comprising at least 85 per cent by weight of acrylonitrile units.

The invention provides acrylic filaments incorporating as flame-retardant a reaction product of a dibasic acid amide, an oxyacid of phosphorus and a polyhydric alcohol.

It is known that acrylic filaments are particularly resistant to penetration by chemicals and there has been a problem in finding flame-retardants having sufficient permanence in acrylic filaments. We have found that the flame-retardants used in accordance with this invention can be strongly bonded to the acrylic filaments if they are incorporated in the acrylic filaments together with a crosslinking agent. The cross-linking agent is a polyfunctional compound capable of reacting with the flame-retardant and of becoming bound to the acrylic filaments more firmly than the flame-retardant alone can be.

The flame-retardant is preferably prepared by reacting together the dibasic acid amide, the oxyacid of phosphorus and the polyhydric alcohol in a molar ratio of 0.5 – 8 : 1 : 0.6 – 2.5. The molar ratio of dibasic acid amide : oxyacid of phosphorus is preferably 0.5 – 2 : 1, although ratios of 2 – 8 : 1 also give a satisfactory flame-retardant. The preferred amide is urea, although guanidine, succinamide and alkyl-substituted ureas can be used. The term oxyacid of phosphorus is used herein to include oxy-compounds of phosphorus containing acidic hydrogen such as monoammonium phosphate, diammonium phosphate, and monomagnesium phosphate as well as acids such as orthophosphoric, pyrophosphoric and metaphosphoric acids. The preferred polyhydric alcohol is glycerol, but for example sorbitol, ethylene glycol or mannitol can be used instead. The reaction is carried out at 100° to 160°C. The time required for completion of the reaction is generally up to 4 hours.

One type of polyfunctional compound useful as a cross-linking agent is a substituted amine containing two or more amine groups N-substituted by hydroxyalkyl or alkoxyalkyl groups. Preferred compounds include partially or fully methylated melamine-formaldehyde precondensates, for example both partially and fully methylated hexakis-hydroxymethyl melamine are effective, as is a liquid melamineformaldehyde precondensate in which 4 to 5 of the six amine hydrogen atoms are replaced by hydroxymethyl groups and half the hydroxymethyl groups are methylated.

An alternative group of cross-linking agents which have been found effective comprise tetrakis-hydroxymethyl phosphonium salts and tris-hydroxymethyl phosphine oxide. The preferred salt is tetrakis-hydroxymethyl phosphonium chloride, but the bromide, phosphate, sulphate or acetate can be used.

The substituted phosphonium salts have themselves been suggested for reducing the combustibility of fibres, but a problem has been that the fabrics formed from fibres so treated have a harsh handle. This is not encountered with the flame-retardants used in accordance with the present invention, which make the handle of the fibre slightly softer even when used with cross-linking agents which themselves harden the handle.

The acrylic filaments are heated, preferably at 90°C to 150°C, together with the flame-retardant and cross-linking agent to ensure that the flame-retardant is permanently bound to the filaments. The flame-retardant and cross-linking agent are preferably applied to the filaments together while the filaments are wet. This procedure enables the filaments to take up the flame-retardant readily and aids the intimate corporation of the flame-retardant in the filament. The flame-retardants used in accordance with the invention are particularly suitable for incorporation in acrylic filaments made by a wet spinning process, in which case the wet spun filaments are preferably treated with the flame-retardant and the cross-linking agent before they have been dried. In conventional wet spinning processes, the acrylic filaments pass through one or more washing baths before they are dried. The flame-retardant and cross-linking agent are preferably included in the last bath used to treat the wet filaments before they are dried, to avoid loss of the flame-retardant before it has been permanently bound to the filaments by heating.

In conventional processing the last bath frequently contains a "soft finish" which is a mixture of surface-active agents used to soften the fibre for subsequent processing. We have found that the flame-retardants used in accordance with the invention and the cross-linking agents described above are compatible with conventionally used soft finishes, even those which are emulsion based.

The amount of flame-retardant used varies according to the end-use of the filaments produced and the standard of flame-resistance required. For carpets, 2 to 10 per cent by weight is usually required, depending on the closeness of the carpet construction. Other fabrics may require up to 25 per cent by weight; low denier fabrics and those of open construction requiring the higher amounts. The concentration of flame-retardant in the treatment bath is generally 10 to 100 g. per liter to achieve these amounts of flame-retardancy in the filaments. We have found that the ratio of cross-linking agent to flame-retardant in the treatment bath should usually be from 1 : 4 to 3 : 1 by weight for the cross-linking agents discussed above. The ratio of cross-linking agent to flame-retardant can be varied according to the properties desired in the fibre. Relatively low ratios, for example 1 : 4 to 1 : 2 may be preferred if a high resistance to flame is required for only a small amount of total additive applied to the fibre and resistance to cleaning is not a problem. Conversely if flame-retardance has to be maintained through several cleaning cycles a high ratio, for example 1 : 1 to 3 : 1, may be preferred. In general we have found that flame-retardants of the invention prepared using a low ratio of dibasic acid amide to oxyacid of phosphorus, for example 0.5 – 2 : 1, show a better resistance to cleaning when used with the cross-linking agents discussed above.

During normal processing we have found that there is no problem of the flame-retardant and cross-linking agent prematurely reacting with each other. However, it is preferred that they should be kept separate before being added to the treatment bath. If the treatment is carried out in the soft finish bath, either the flame-retardant or the cross-linking agent can be premixed with the soft finish and continuously fed to the bath.

Although the flame-retardants of the invention have satisfactory properties when used alone, and are preferably so used for most purposes, they can be used in conjunction with other flame-retardants. These can be of the type which are mixed with the acrylic polymer before it is spun, for example a liquid brominated diphenyl ether as disclosed in U.S. Pat. application Ser. No. 388,160 filed Aug. 13, 1973.

The invention is illustrated by the following Examples, in which percentages are by weight.

EXAMPLE 1

264 grams urea (4.4 moles), 92 grams glycerol (1.0 mole) and 118 grams orthophosphoric acid (1.2 moles) were mixed together and warmed. When the reaction mixture was fully homogeneous the temperature was raised to 160°C and the mixture was maintained at this temperature for 13 minutes. Ammonia and carbon dioxide were rapidly evolved and some urea sublimed. The flame-retardant produced was a white hydroscopic mass containing 8.3 per cent phosphorus.

A copolymer of 93 per cent acrylonitrile units, 6 per cent methyl acrylate units and 1 per cent itaconic acid units was dissolved in a 51 per cent aqueous solution of sodium thiocyanate to give a copolymer concentration of 12.8 per cent. The resulting spinning dope was spun into an aqueous regenerating bath containing 11 per cent sodium thiocyanate at a temperature of 10°C to form Courtelle acrylic filaments. These were stretched in steam and washed and were then taken up on a cheese while still wet. Several identical hanks of wet acrylic filaments were prepared by allowing the fibre guide to traverse in both directions 100 times to build up each hank. The diameter of the cheese was 2.5 inches (63 mm) and the length of traverse was 5.5 inches (140 mm).

Three treatment baths were prepared containing varying amounts of the flame-retardant prepared above and a cross-linking agent. The cross-linking agent was a liquid melamine formaldehyde resin sold as "BC 336" in which 4 – 5 of the amine hydrogens of melamine are replaced by hydroxymethyl groups and half the hdyroxymethyl groups are methylated. The treatment bath also contained a commercial soft finish to more closely simulate the conditions of manufacture of acrylic filaments. The hank of wet acrylic filaments was dunked in the treatment bath 10 times, mangled to remove excess water and was then dried at 120°C for 20 minutes. These drying conditions, which are typical of those used in the manufacture of acrylic filaments, served to fix the cross-linking agent and flame-retardant on the filaments. The filaments produced were of count 15 d.Tex.

In commercial practice, of course, the treatment bath would be situated in line between the washing and drying steps; the treatment conditions used in these Examples attempt to simulate as closely as possible such commercial conditions.

The rate of burning of the acrylic filaments containing the flame-retardant was then measured. The filaments were wound back onto the cheese from the hank to give a web and two portions 2.5 inches × 6 inches (63 mm × 152 mm) were carefully cut from the web. Each portion was clamped between a pair of metal plates and dried in a vacuum oven to constant weight. Each pair of plates, exposing an area of fibre 6 inches × 0.5 inches (152 mm × 13 mm) was then placed vertically in a draught-proof box such that the lower edge of the web was at a level 1 inch (2.5 cm) above the nozzle of a micro-burner which had a 1 inch flame. The web was ignited by moving the burner under the plates, and the time for the flame to travel between two marks 100 mm apart was recorded. If the flame was extinguished before reaching the upper mark, the distance burnt from the lower mark and the time taken to burn this distance were measured.

As a comparison, the rate of burning of unmodified "Courtelle" acrylic filaments was measured in this test as 8.70 mm/sec. The rate of burning of acrylic filaments containing 7.5 per cent of the bromine-containing flame-retardant of U.K. Application 38179/72 was measured as 7.64 mm/sec. As shown by Example 2 of the said U.K. Application, carpets of varying constructions made from the latter filaments all satisfied the American Pill flame-retardance test defined in DOC FF 1 – 70. Both the unmodified and the bromine-containing acrylic filaments burnt the full 100 mm in each individual rate of burning test.

The results for the three treatments according to the invention are tabulated below. In each case, the weight ratio of flame-retardant to cross-linking agent in the bath was 3 : 1.

| Concentration of flame-retardant in bath | Distance burnt (if less than 100 mm) | Rate of burning (mm/sec.) | Percentage Phosphorus in Filaments |
|---|---|---|---|
| 3.75 per cent | 95 mm | 4.69 | 0.70 |
| 6 per cent | 43 mm | 4.62 | 0.87 |
| 7.5 per cent | 70 mm | 4.14 | 1.12 |

EXAMPLE 2

The same flame-retardant, cross-linking agent and acrylic filaments were used as in Example 1, but the treatment bath contained 1.75 per cent of the flame-retardant and 5.25 per cent of the cross-linking agent. The rate of burning, calculated as described in Example 1, was 7.18 mm/sec., the distance burnt being 95 mm.

The resistance of the flame-retardant filaments to washing was measured. 1 gram of hand-carded fibre prepared from the filaments was soaked in 18 ml of a commercial carpet shampoo solution (2 ml of Bex Bissell concentrate to 16 ml water) with occasional agitation. The fibre was rinsed and dried. The phosphorus content of the fibre was 0.217 per cent before washing and 0.210 per cent after washing, i.e. there was a loss of phosphorus of only 3.2 per cent. The filaments of Example 1 may lose up to two-thirds of their phosphorus under these conditions.

EXAMPLE 3

185 grams urea (3.08 moles), 92 grams glycerol (1.0 mole) and 118 grams orthophosphoric acid (1.2 moles) were reacted together under the conditions described in Example 1. The flame-retardant produced was a clear glassy hygroscopic solid containing 13.6 per cent phosphorus.

A hank of wet acrylic filaments prepared as described in Example 1 was dunked in a treatment bath containing 3.75 per cent of this flame-retardant and 1.25 per cent of BC.336 cross-linking agent and dried as described in Example 1. The treated filaments contained 1.07 per cent phosphorus. The rate of burning, measured as described in Example 1, was 4.01 mm/sec for a distance burnt of 84 mm.

EXAMPLE 4

60 grams urea (1.0 mole), 132 grams diammonium hydrogen orthophosphate (1.0 mole) and 92 grams glycerol (1.0 mole) were mixed together and heated at 155° – 160°c until effervescence had ceased and the reaction mixture had cleared. The crude product, a colourless liquid, was allowed to cool in a dessicator where it solidified and became cloudy. The flame-retardant produced contained 12.9 per cent phosphorus, of which 2.7 per cent appeared to be in the form of unreacted diammonium hydrogen phosphate.

A hank of wet acrylic filaments prepared as described in Example 1 was dunked in a treatment bath containing 5.25 per cent of this flame-retardant and 1.75 per cent of BC 336 cross-linking agent and dried as described in Example 1. The treated filaments contained 1.19 per cent phosphorus. Their rate of burning, measured as described in Example 1, was 5.01 mm/sec.

A fibre sample prepared from the treated filaments was washed as described in Example 2. The loss of phosphorus was 5.0 per cent after one such wash and 10.7 per cent after two washes.

EXAMPLE 5

A treatment bath was prepared containing 1.75 per cent of the flame-retardant of Example 4 and 5.25 per cent of BC 336 cross-linking agent. A hank of wet acrylic filaments was dunked and dried as described in Example 1. The treated filaments contained 0.33 per cent phosphorus. Their rate of burning, measured as described in Example 1, was 7.30 mm/sec.

In the washing test as described in Example 2, the loss of phosphorus of the treated filaments after two washes was 7.1 per cent.

EXAMPLE 6

30 grams urea (0.5 mole), 98 grams orthophosphoric acid (1.0 mole) and 92 grams glycerol (1.0 mole) were mixed together and warmed at 90°C. When the reaction mixture was completely homogenous, the temperature was raised to 158° – 160°C and the mixture was maintained at this temperature until foaming due to evolution of ammonia and carbon dioxide ceased and the mixture became clear. The crude product was a dark brown viscous oil containing 13.2 per cent phosphorus, of which 6.1 per cent appeared to be unreacted orthophosphoric acid.

A hank of wet acrylic filaments prepared as described in Example 1 was dunked in a treatment bath containing 1.75 per cent of the flame-retardant thus produced and 5.25 per cent of BC 336 cross-linking agent and dried as described in Example 1. The treated filaments contained 0.45 per cent phosphorus. Their rate of burning, measured as described in Example 1, was 6.20 mm/sec., the distance burnt being 80 mm.

In the washing test as described in Example 2, the loss of phosphorus of the treated filaments was measured as slightly negative, even after two washes, indicating a negligible loss of flame-retardant on washing.

EXAMPLE 7

30 grams urea (0.5 mole), 132 grams diammonium hydrogen orthophosphate (1.0 mole) and 92 grams glycerol (1.0 mole) were reacted together under the conditions described in Example 4. The flame-retardant produced was a colourless liquid which solidified and became cloudy on cooling and contained 12.4 per cent phosphorus, of which 6.4 per cent appeared to be in the form of unreacted diammonium hydrogen phosphate.

A hank of wet acrylic filaments prepared as described in Example 1 was dunked in a treatment bath containing 1.75 per cent of this flame-retardant and 5.25 per cent of BC 336 cross-linking agent and was dried as described in Example 1. The treated filaments contained 0.33 per cent phosphorus. Their rate of burning, measured as described in Example 1, was 7.30 mm/sec.

A fibre sample prepared from the treated filaments was washed as described in Example 2. The loss of phosphorus was 10 per cent after washing.

What is claimed is:

1. Acrylic filaments containing a flame retardant which is the reaction product of a dibasic acid amide, an oxyacid of phosphorus and a polyhydroxyl alcohol, the flame retardant being bound to the acrylic filaments by a cross-linking agent selected from the group consisting of tetrakis-hydroxymethyl phosphonium salts, tris-hydroxymethyl phosphine oxide and substituted amines containing two or more amine groups substituted by groups selected from hydroxyalkyl and alkoxyalkyl groups.

2. Acrylic filaments as claimed in claim 1 wherein the dibasic acid amide is urea.

3. Acrylic filaments as claimed in claim 1 wherein the polyhydric alcohol is glycerol.

4. Acrylic filaments as claimed in claim 1 wherein the oxyacid of phosphorus is diammonium hydrogen orthophosphate.

5. Acrylic filaments as claimed in claim 1 wherein the molar ratio of dibasic acid amide : oxyacid of phosphorus : polyhydric alcohol is in the range of 0.5 – 8 : 1 : 0.6 – 2.5.

6. Acrylic filaments as claimed in claim 5 wherein the molar ratio of dibasic acid amide to oxyacid of phosphorus is 0.5 – 2 : 1.

7. Acrylic filaments as claimed in claim 1 wherein the cross-linking agent is a melamine formaldehyde precondensate.

8. Acrylic filaments as claimed in claim 1 containing 2 to 25 per cent by weight of the said flame retardant.

9. Acrylic filaments as claimed in claim 1 wherein the proportion of the said flame retardant to the cross-linking agent is 4 : 1 to 1 : 3.

10. A method of making the acrylic filaments claimed in claim 1 comprising applying to the acrylic filaments while they are in a wet state the said flame retardant and the said cross-linking agent and subsequently heating the filaments at a temperature of 90°C to 150°C to chemically bind the flame retardant to the acrylic filaments.

11. A method as claimed in claim 9 comprising the initial step of preparing acrylic filaments by a wet spinning process, the flame retardant and the cross-linking agent being applied to the filaments before they have been dried.

* * * * *